US008333141B2

(12) United States Patent
Schøning-Olsen et al.

(10) Patent No.: US 8,333,141 B2
(45) Date of Patent: Dec. 18, 2012

(54) RECOIL ABSORBING ASSEMBLY FOR AUTOMATIC WEAPONS

(75) Inventors: Sigvart Schøning-Olsen, Hvasser (NO); Jan Marius Hektoen, Nøtterøy (NO)

(73) Assignee: Vinghog AS, Notteroy (NO)

( * ) Notice: Subject to any disclaimer, the term of this patent is extended or adjusted under 35 U.S.C. 154(b) by 224 days.

(21) Appl. No.: 12/711,573

(22) Filed: Feb. 24, 2010

(65) Prior Publication Data

US 2011/0203454 A1 Aug. 25, 2011

(51) Int. Cl.
*F41A 25/14* (2006.01)
*F41A 25/08* (2006.01)

(52) U.S. Cl. ..... 89/44.01; 89/42.01

(58) Field of Classification Search ..... 89/44.01, 89/44.02, 42.01; 188/136
See application file for complete search history.

(56) References Cited

U.S. PATENT DOCUMENTS

| | | | | | |
|---|---|---|---|---|---|
| 436,375 | A * | 9/1890 | Nordenfelt | 89/44.01 |
| 526,407 | A * | 9/1894 | Brankston et al. | 89/44.01 |
| 636,976 | A * | 11/1899 | Garland | 89/44.01 |
| 988,776 | A * | 4/1911 | Haussner | 89/44.01 |
| 2,539,275 | A * | 1/1951 | Sahlin et al. | 89/44.01 |
| 3,783,738 | A * | 1/1974 | Pelat | 89/44.01 |
| 4,016,799 | A * | 4/1977 | Le Pierres | 89/44.01 |
| 5,159,148 | A | 10/1992 | Vinhog | |
| 6,347,568 | B1 * | 2/2002 | Soulaigre | 89/42.01 |
| 6,719,101 | B2 * | 4/2004 | Hugel | 187/376 |
| 7,036,638 | B2 * | 5/2006 | Simmonds et al. | 187/376 |
| 2003/0085078 | A1 * | 5/2003 | Simmonds et al. | 187/376 |

FOREIGN PATENT DOCUMENTS

| | | | |
|---|---|---|---|
| DE | 730010 | C | 1/1943 |
| DE | 8812370 | U1 | 2/1990 |
| FR | 2283417 | A1 | 3/1976 |
| GB | 14804 | A | 0/1910 |
| GB | 1386823 | A | 3/1975 |

* cited by examiner

*Primary Examiner* — Jonathan C Weber
(74) *Attorney, Agent, or Firm* — Volpe and Koenig, P.C.

(57) ABSTRACT

A recoil absorbing assembly is provided for automatic weapons secured to a weapon cradle having a fixed portion and a portion movable longitudinally thereto, the fixed cradle portion being rotatably mounted to a support, including a recoil absorbing spring and friction device arranged in connection with the cradle portions. Further the friction device includes a main shaft provided with angled friction blocks and a movable bearing housing surrounding the main shaft and having free floating pistons as to cooperate with the friction blocks, the recoil absorbing spring being situated on the main shaft in elongation of the bearing housing.

9 Claims, 5 Drawing Sheets

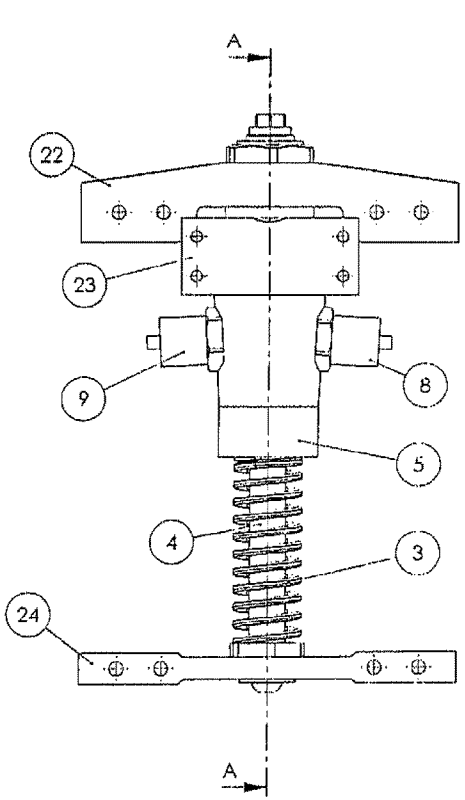
Fig. 1a
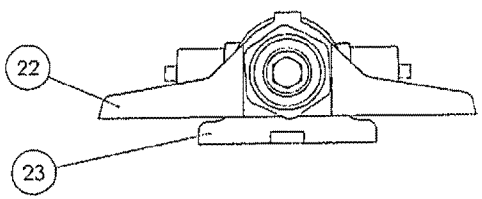
Fig. 1b
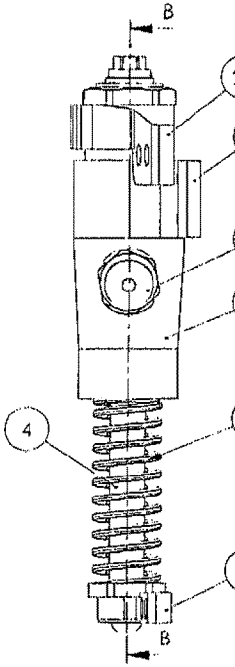
Fig. 1c
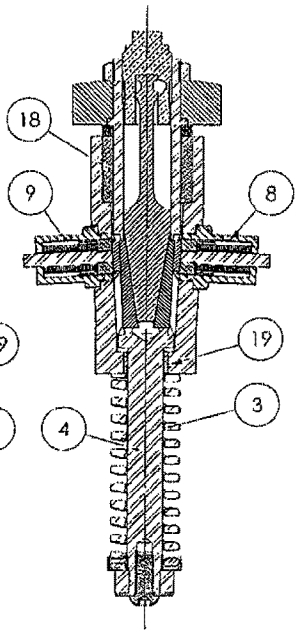
Fig. 1d
Fig. 1e

RECOIL ABSORBING ASSEMBLY FOR AUTOMATIC WEAPONS

FIELD OF INVENTION

The present invention relates to a recoil absorbing assembly for automatic weapons, and in particular an assembly in which the recoil energy is absorbed by means of spring and friction force.

BACKGROUND

A lot of solutions similar to the assembly mentioned above is known in the prior art. One typical example is presented by U.S. Pat. No. 5,159,148 in which the friction force is effected by means of sliding guides comprising a bolt secured to the fixed cradle portion and protruding through a slot in the movable cradle portion and more than one such sliding guide are needed i.e. often three pairs at the longitudinal sides of the two cradle portions. Despite this fact and due to torsional movements, practice has also proved that the precision during firing is not satisfactorily involving that the actual targets are missed. Other secondary disadvantages are increased weight and manufacturing costs.

SUMMARY

The objects of the present invention are to remedy this disadvantages and these are achieved by a recoil absorbing assembly for automatic weapons secured to a weapon cradle having an fixed portion and a portion longitudinally movable thereto, the fixed cradle portion being rotatably mounted to a support, comprising a recoil absorbing spring and a friction device arranged in connection with the cradle portions, wherein the friction device includes a main shaft provided with angled friction blocks and a movable bearing housing surrounding the main shaft and having free floating pistons as to cooperate with the friction blocks, the recoil absorbing spring being situated on the main shaft in elongation of the bearing housing.

To adapt the present recoil absorbing assembly to different types of automatic weapons and ammunitions, the main shaft is provided with a mechanism that tunes the friction by pushing the friction blocks outwards. The friction tuning mechanism can include a shaft portion longitudinally movable using a tension sleeve arranged in an end of the mains shaft opposite of the friction blocks.

To further increase the friction effect, the angled friction blocks are formed with inclined surfaces adjacent corresponding surface portions of the main shaft. Friction block surfaces opposite of the main shaft can be inclined vertically. Further, the free floating pistons can be situated in a manner forming an angle to the main shaft, preferentially 4°. The free floating pistons can be provided with friction increasing portions adjacent the friction blocks, and spring biased against the friction blocks.

To enable unobstructed longitudinal movements relatively to the main shaft, the bearing housing is formed with bearings arranged at each end thereof and surrounding the main shaft. The bearings can be made from metal, preferentially bronze.

To secure the recoil absorbing assembly, the main shaft is connected to the fixed cradle portion, whereas the bearing housing is connected to the movable cradle portion by preferentially using brackets situated in each end of the main shaft and one end of the bearing housing, respectively.

The present recoil absorbing assembly allows for mounting and firing of automatic weapons such as heavy machine guns and 40 mm automatic grenade launchers from the soft-mount. The recoil is absorbed by using spring force and decreasing/increasing friction which transfers the recoil energy into heat. Thereby, the precision during firing is increased and the weight of the unit including inter alia the recoil absorbing assembly and weapon cradle is reduced.

The recoil absorbing assembly according to the present invention consists of two main parts. A main shaft including the angled and adjustable friction blocks and its integrated tuning mechanism. The main shaft also acts as a guide for the recoil spring. The second main part is the bearing housing which during recoil travels back and forth along the main shaft. When the assembly is in its forward i.e. extracted position, the recoil spring is preloaded and the forward position is hold by the friction force created by the two pistons trusting against the friction blocks inside the main shaft. When the recoil of the weapon pushes the bearing housing rearwards the recoil spring is compressed and the friction force is slowly decreasing due to the angled friction blocks. On its return, the increasing friction force creates a "soft stop" of the assembly before it enters the physical end stop of the assembly.

The integrated tuning assembly allows the operator to tune the friction force involving that the two friction blocks are pushed outwards. By tuning the friction force, an adaptation to the different weapons it is possible as to get maximum dampening effect and achieve reliability of the weapons also when firing at high elevations. The recoil spring is also having separate tuning mechanism involving that its spring force needed can be set for the actual weapons.

BRIEF DESCRIPTION OF THE DRAWINGS

Now, the present invention is to be discussed in detail with reference to preferred embodiment illustrated in the accompanying drawings, in which:

FIGS. 1*a-e* show an recoil absorbing assembly in bottom and front perspective, vertical sectional, side perspective and horizontal sectional views, respectively, presented in a extended position;

DETAILED DESCRIPTION OF THE PREFERRED EMBODIMENTS

Figure 4A:
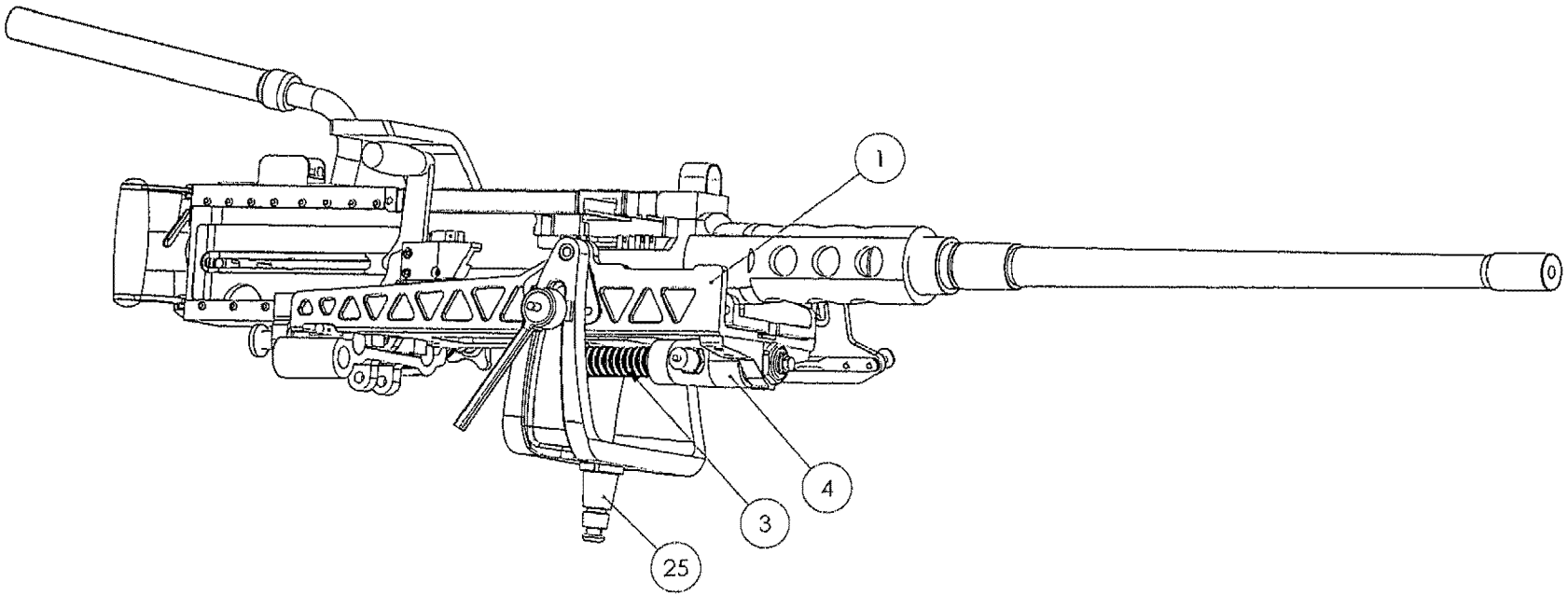
FIGS. 4*a-b* show the assembly used for different types of automatic weapons in perspective views, seen from the left and right hand sides.
Figure 4B:
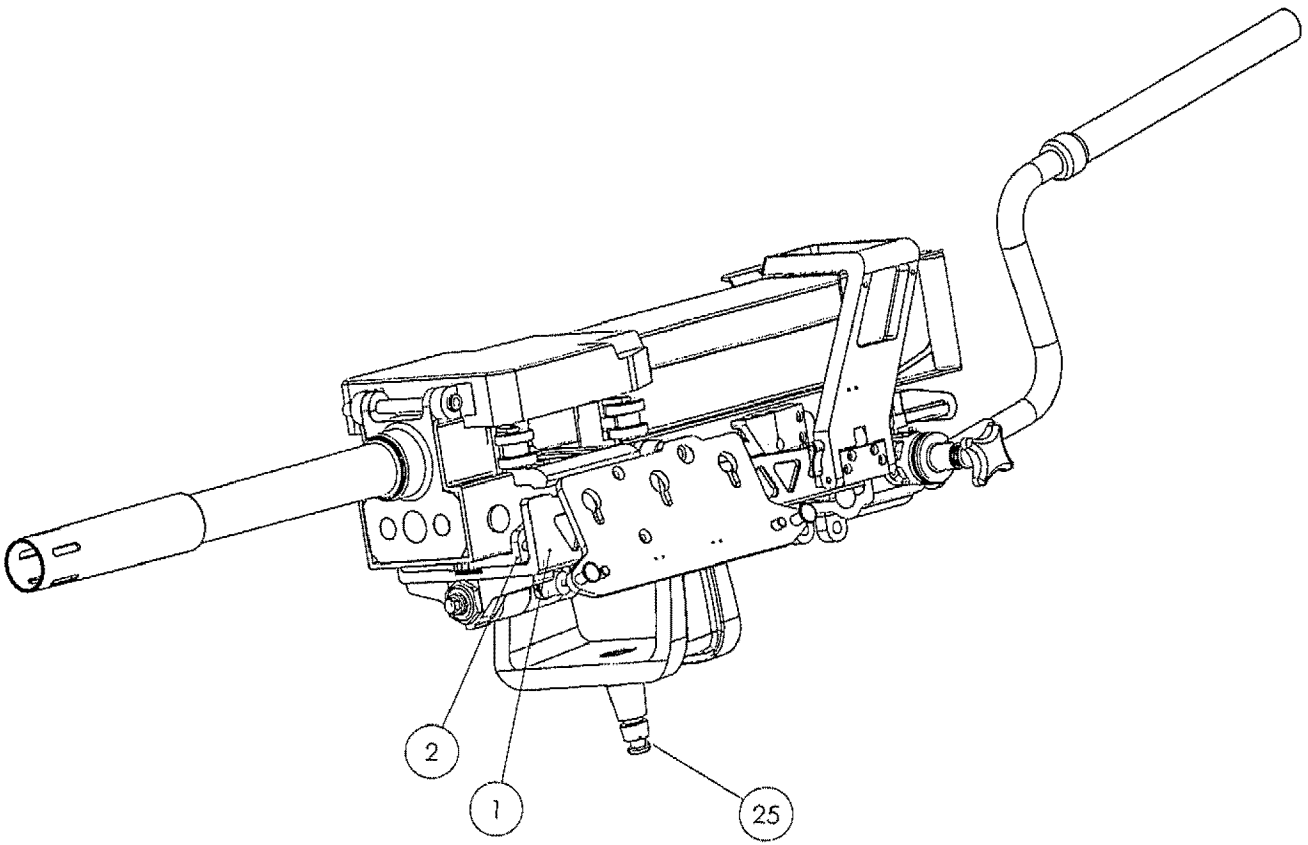

According to the present invention, the recoil absorbing assembly allows mounting and firing of automatic weapons such as heavy machine guns and 40 mm automatic grenade launchers from the soft-mount. As illustrated in FIGS. 4*a-b*, two different weapons are mounted in a weapon cradle having a fixed portion 1 and a portion 2 longitudinally movable thereto. The fixed cradle portion is rotatably mounted to a suitable support, not shown, by a pin connection 25, for instance. The fixed and movable cradle portions can be formed in any appropriate manner but these features are not part of the present invention and are not be discussed in detail herein as well as the others depicted in FIGS. 4*a-b*.

Figure 2C:
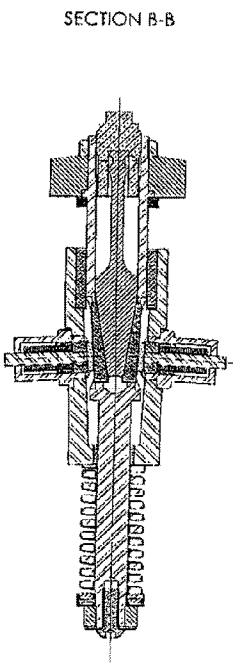
FIGS. 2*a-c* show the same assembly in bottom perspective, vertical and horizontal sectional views, respectively, presented in the compressed position.
Figure 2B:
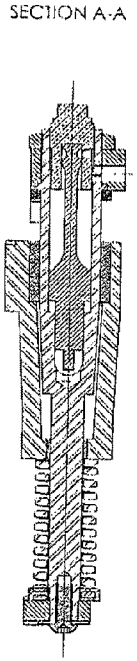
Figure 2A:
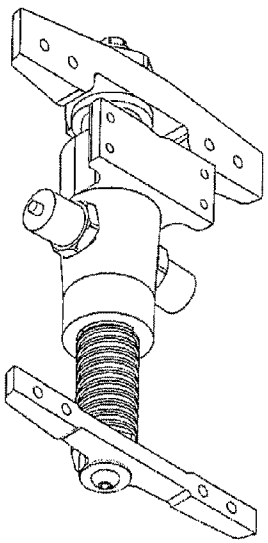
Figure 3:
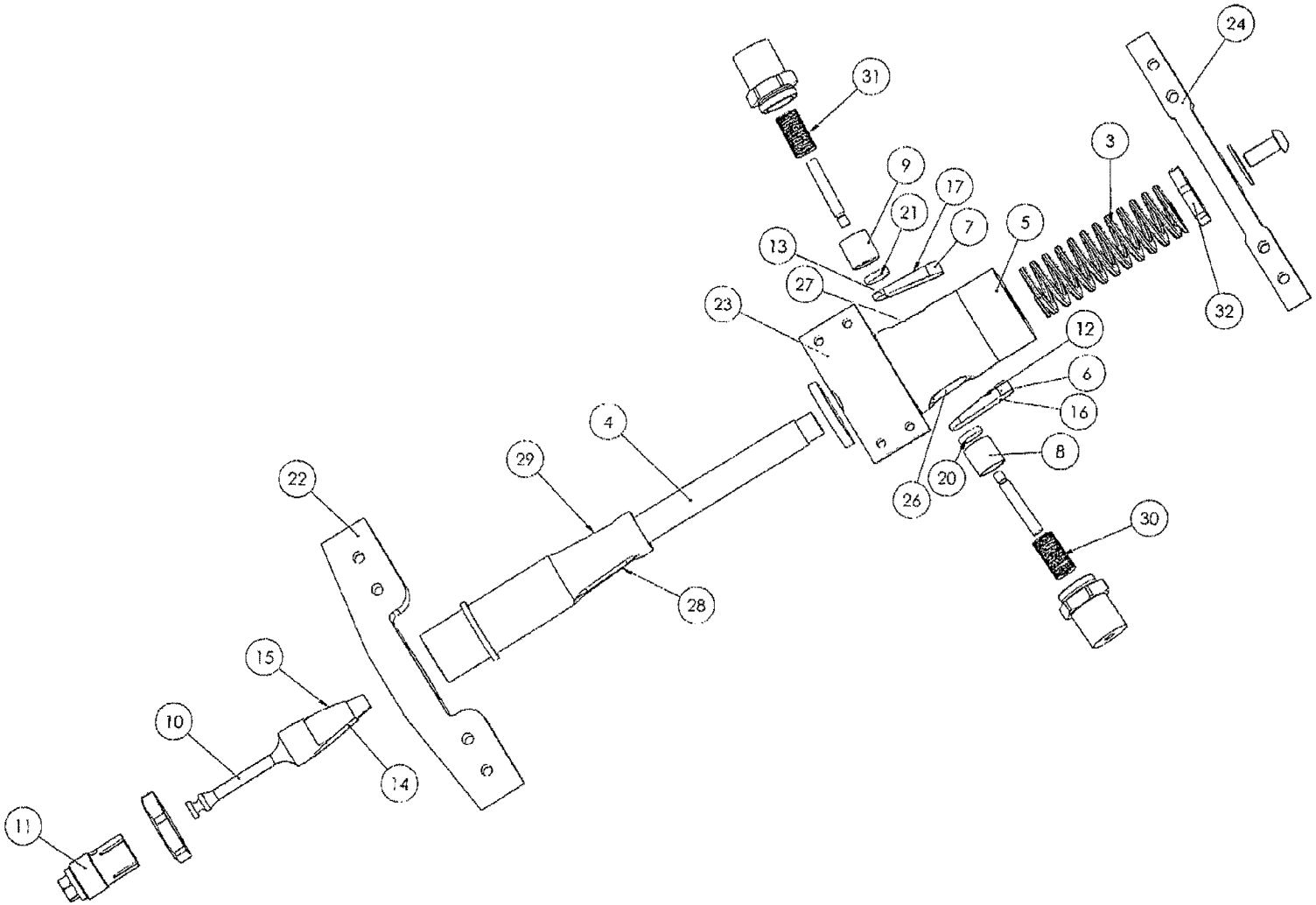
FIG. 3 shows an exploded top perspective view of the same assembly.

As shown in FIGS. 1-3, the present assembly includes a recoil absorbing spring 3 and friction device 4, 5 known per se and arranged in connection with the cradle portions. However, contrary to the prior art the present friction device include a main shaft 4 provided with angled friction blocks 6, 7 and a movable bearing housing 5 surrounding the main shaft and having free floating pistons 8, 9 as to cooperate with the friction blocks, whereas the recoil absorbing spring 3 being situated on the main shaft in elongation of the bearing housing; cf. FIG. 1*e*, for instance 11. The main shaft 4 is connected to the fixed cradle portion 1, whereas the bearing housing 5 is connected to the movable cradle postion 2 by preferentially using brackets 22, 23, 24 situated in each end of the main shaft and one end of the bearing housing, respectively, see FIG. 1*a*. It is understood that the brackets illustrated can be replaced by other suitable members.

The angled friction blocks 6, 7 are formed with inclined surfaces 12, 13 adjacent corresponding surface portions 14, 15 of the main shaft 4. The respective inclined surfaces and surface portions of the friction blocks and main shaft, respectively, are preferentially planar but this other configurations such as angled or curved are not excluded. The friction effect is increased by friction block surfaces 16, 17 opposite of the main shaft portion 10 being vertically inclined. The slope of these surfaces can be varied as to fit to different weapon and ammunition types.

Further, the main shaft 4 is provided with a mechanism 10, 11 tuning the friction by pushing the friction blocks 6, 7 outwards. This mechanism could include a main shaft portion 10 longitudinally movable using a tension sleeve 11 arranged in an end of the mains shaft 4 opposite of the friction blocks 6, 7. The shaft portion and tension sleeve are arranged in connection with a bore within the main shaft and are mutually rotatably using a ball bearing 26, for instance. These can be secured using appropriate securing elements.

The movable bearing housing 5 is formed with bearings 18, 19 arranged at each end thereof and surrounding the main shaft 4, see FIG. 1*c*. These bearings are made from metal, preferentially bronze.

The free floating pistons 8, 9 arranged in the bearing housing 5 are situated in a manner forming an angle to the main shaft 4, preferentially 4°. The pistons are within apertures 26, 27 made therethrough and are communicating with corresponding apertures 28, 29 formed in the main shaft 4, whereby the friction blocks 6, 7 are pressed against the shaft portion 10. Additionally, the floating pistons are provided with friction increasing portions 20, 21 adjacent the friction blocks and are spring biased against these friction blocks. The floating pistons are preferentially biased using cup springs 30, 31 but other types of springs are also applicable.

Although FIG. 1-3 illustrate more elements than discussed above, these shall only be considered as examples of supplementary accessories and not understood in a restrict manner. Moreover, it is noted that the exploded view in FIG. 3 is not including the bearings 18, 19 situated in each end of the bearing housing 5. The spring force of the recoil spring 3 can be adjusted to different types of weapons and ammunitions by appropriate adjustors such as a set screw 32.

What is claimed is:

1. A recoil absorbing assembly for automatic weapons secured to a weapon cradle having an fixed portion (1) and a portion (2) movable longitudinally thereto, wherein the fixed cradle portion is rotatably mounted to a support, and wherein the assembly comprises a recoil absorbing spring (3) and a friction device (4, 5) arranged in connection with the cradle portions, wherein the friction device includes a main shaft (4) provided with angled friction blocks (6, 7) and a movable bearing housing (5) surrounding the main shaft, wherein the bearing housing (5) comprises free floating pistons (8, 9) arranged in the bearing housing (5) and spring biased against the friction blocks, the recoil absorbing spring (3) being situated on the main shaft in elongation of the bearing housing, wherein the main shaft (4) is provided with a mechanism (10, 11) that tunes the friction by pushing the friction blocks (6, 7) outwards, the friction tuning mechanism includes a shaft portion (10) longitudinally movable using a tension sleeve (11) arranged in an end of the main shaft (4) opposite of the friction blocks (6, 7).

2. A recoil absorbing assembly according to claim 1, wherein the angled friction blocks (6, 7) are formed with inclined surfaces (12, 13) adjacent corresponding surface portions (14, 15) of the main shaft (4).

3. A recoil absorbing assembly according to claim 2, wherein friction block surfaces (16, 17) opposite of the main shaft portion (10) are inclined vertically.

4. A recoil absorbing assembly according to claim 1, wherein the movable bearing housing (5) is formed with bearings (18, 19) arranged at each end thereof and surrounding the main shaft (4).

5. A recoil absorbing assembly according to claim 4, wherein the bearings (18, 19) are made from metal, preferentially bronze.

6. A recoil absorbing assembly according to claim 1, wherein the free floating pistons (8, 9) are situated in a manner forming an angle to the main shaft (4), preferentially 4°.

7. A recoil absorbing assembly according to claim 6, wherein the free floating pistons (8, 9) are provided with friction increasing portions (20, 21) adjacent the friction blocks (6, 7).

8. A recoil absorbing assembly according to claim 1, wherein the free floating pistons (8, 9) are spring biased against the friction blocks (6, 7).

9. A recoil absorbing assembly according to claim 1, wherein the main shaft (4) is connected to the fixed cradle portion (1), whereas the bearing housing (5) is connected to the movable cradle portion (2) by using brackets (22, 23, 24) situated in each end of the main shaft and one end of the bearing housing, respectively.

* * * * *